US006616399B1

(12) United States Patent
Stevens

(10) Patent No.: US 6,616,399 B1
(45) **Date of Patent: *Sep. 9, 2003**

(54) GRIPPER ARM ASSEMBLY

(76) Inventor: Kenneth A. Stevens, 701 N. Raddant Rd., Batavia, IL (US) 60510-4218

( * ) Notice: Subject to any disclaimer, the term of this patent is extended or adjusted under 35 U.S.C. 154(b) by 0 days.

This patent is subject to a terminal disclaimer.

(21) Appl. No.: 09/875,581

(22) Filed: Jun. 6, 2001

Related U.S. Application Data

(63) Continuation-in-part of application No. 09/165,577, filed on Oct. 2, 1998, now abandoned, which is a continuation of application No. 08/733,396, filed on Oct. 18, 1996, now Pat. No. 5,816,771, which is a continuation of application No. 08/401,184, filed on Mar. 9, 1995, now abandoned.

(51) Int. Cl.[7] ..... B66C 1/42

(52) U.S. Cl. ..... 414/740; 414/739; 248/230.5; 403/390; 403/391

(58) Field of Search ..... 414/591, 729, 414/740; 901/16; 212/312, 319, 324; 271/85; 403/389, 390, 391, 396, 384; 248/230.5, 230.1, 68.1; 198/468.2, 409; 29/718

(56) References Cited

U.S. PATENT DOCUMENTS 3,604,687 A * 9/1971 Moore ..... 403/391 X
4,595,162 A * 6/1986 Matsumura et al. ..... 248/68.1
4,634,107 A * 1/1987 Vandersyde et al. ..... 271/85 X
5,072,880 A * 12/1991 McCloud ..... 273/85 D
5,324,017 A * 6/1994 Bubley et al. ..... 271/85
5,816,771 A * 10/1998 Stevens ..... 414/729

* cited by examiner

*Primary Examiner*—Donald W. Underwood
(74) *Attorney, Agent, or Firm*—Barnes & Thornburg

(57) ABSTRACT

An improved gripping arm assembly including a two-piece gripper arm body construction which includes an arm clamp having alignment pins, and an arm main body with corresponding alignment holes for receiving the clamp pins, and a means for securably attaching the main body with the clamp. This two-piece gripper arm construction is simpler to remove than one-piece standard gripper arms. To replace a broken gripper arm with a new gripper arm only requires unscrewing fasteners holding the two-piece old gripper arm together allowing detachment of the broken gripper arm from the shaft, and clamping the two pieces of the new gripper arm together around the shafts and securing the screws and re-clipping an operating rod. The two-piece construction eliminates the need to remove a shaft from the machine or other gripper arms from the shaft when repairing or replacing one gripper arm or replacing or repairing a shaft having gripper arms mounted thereto.

6 Claims, 5 Drawing Sheets

22
12
28
26
26a
26b
24
14
30
50

GRIPPER ARM ASSEMBLY

RELATED APPLICATIONS

This application is a continuation-in-part application of application Ser. No. 09/165,577 filed on Oct. 2, 1998, now abandoned, which is a continuation application of application Ser. No. 08/733,396 filed on Oct. 18, 1996 (U.S. Pat. No. 5,816,771 issued Oct. 6, 1998), which is a continuation of application Ser. No. 08/401,184 filed on Mar. 9, 1995, now abandoned.

TECHNICAL FIELD

This invention relates to a gripping apparatus for use as an industrial manipulator for gripping items, more particularly to an improvement of the gripping apparatus used in a machine which may be removed from one or more shafts mounted in the machine or without sliding the gripper apparatus off an end of the shafts or removing the shafts from the machine.

BACKGROUND OF THE INVENTION

Presently, there exist a number of machines that perform the function of inserting envelopes, manipulating garbage bags for packaging, and generally for transferring items on a machine from one location on the machine to other locations on the machine.

Many of the envelope inserting machines have the capacity for performing the functions of separating inserts from a stack, opening the envelopes, inserting mailing inserts inside the envelopes, putting predetermined printed matter on the envelopes, and sealing the envelopes. Having a machine that can perform all these functions can be very beneficial to the user, especially for the user having a large capacity of mailings to be mailed. However, one major disadvantage of using this type of machine is the time and expense used to repair and service the machines. Parts of the machines which require substantial time and cost to repair and service include gripper arms used to grip and move mailing inserts on the machine.

Normally, when an attached gripper arm on the machine needs to be removed for repair or replacement, the entire shaft or shafts to which the gripper arm is attached must be removed from the machine. The existing one piece design for a gripper arm body requires that both a swing shaft and an operating lever shaft be removed. Prior to removing the shafts, extensive time is required to prepare the shafts for removal. The gripper arm is fastened to the swing shaft by tapered pins and set screws. The tapered pins can only be removed from the back of the gripper arm. To move out the pins, the drive must first be disconnected, and then the arms have to be pivoted upside down placing the small end of the tapered pins in position for the removal. The pins are individually removed with a punch device. Additionally, there is a bell crank mounted on the shaft that has two pins that must be removed, and the gripper arm also has a pin that must be removed. The pusher arm must be unclamped and removed. Set screws in collars mounted on the shafts, the gripper arm drive and gripper arms must be loosened. The operating shaft must be removed also. In order to remove the operating shaft, the positioning collar must be removed. The operating lever must be loosened and the operating rod unclipped. After completing these steps the operating shaft can be pulled out of the arms and machine. With the operating shaft removed, each gripper arm (up to six per machine) can be moved to the left or the right to deburr their set screw marks on the shaft. With all the set screw burrs removed, the shaft can be removed slowly to avoid gripper arm damage. Additionally, since all the gripper arms in an inserter machine are mounted on the same set of shafts, other gripper arms attached to the shafts must be removed in order to remove the one gripper arm in need of repair or replacement. Each gripper arm is usually attached to a shaft by one tapered pin, therefore, each tapered pin must be removed. Additionally, collar members attached to these shafts by set screws must be removed. In essence, a number of taper pins must be removed to remove each gripper arm from the shaft and each collar member from the shaft, all in order to just remove one gripper arm. Conversely, when placing a repaired or replacement gripper arm back on the shaft, the other gripper arms must be placed back on the shaft, and repositioned along with the replacement gripper arm on the shaft. Since, removal of a standard gripper arm requires readjustment of all the removed parts, the replacement process could well exceed 2 hours.

SUMMARY OF THE INVENTION

The present invention contemplates eliminating the aforementioned disadvantages of the gripping devices which are mounted on shafts.

It is, therefore, an object of the present invention to provide an improved gripper arm which provides for minimal need of time consuming and costly repair and replacement of gripper arms on a machine utilizing gripper arms mounted on shafts.

In order to accomplish the above described objects, there is provided in the present invention an improved gripping arm assembly having an two-piece gripper arm body comprised of a arm main body and an arm clamp, attachment means for attaching the two-piece gripper arm together and onto one or more shafts, a gripper jaw, a two-piece operating lever, and an operating rod. The two-piece gripper arm body and operating lever construction eliminates the need to remove a shaft from the machine or other gripper arms from the shaft when replacing a gripper arm or operating lever. Only a small number of screws need to be removed to separate the gripper arm into two detached pieces, therefore, greatly simplifying the removal of the complete gripper arm from the inserter machine. The whole process only takes a few minutes to complete. To replace a gripper arm mounted on a shaft requires clamping the two pieces of the gripper arm together around the shafts and securing the screws and re-clipping an operating rod. This replacement process only takes a few minutes as well.

DETAILED DESCRIPTION OF THE PREFERRED EMBODIMENT

Figure 1:
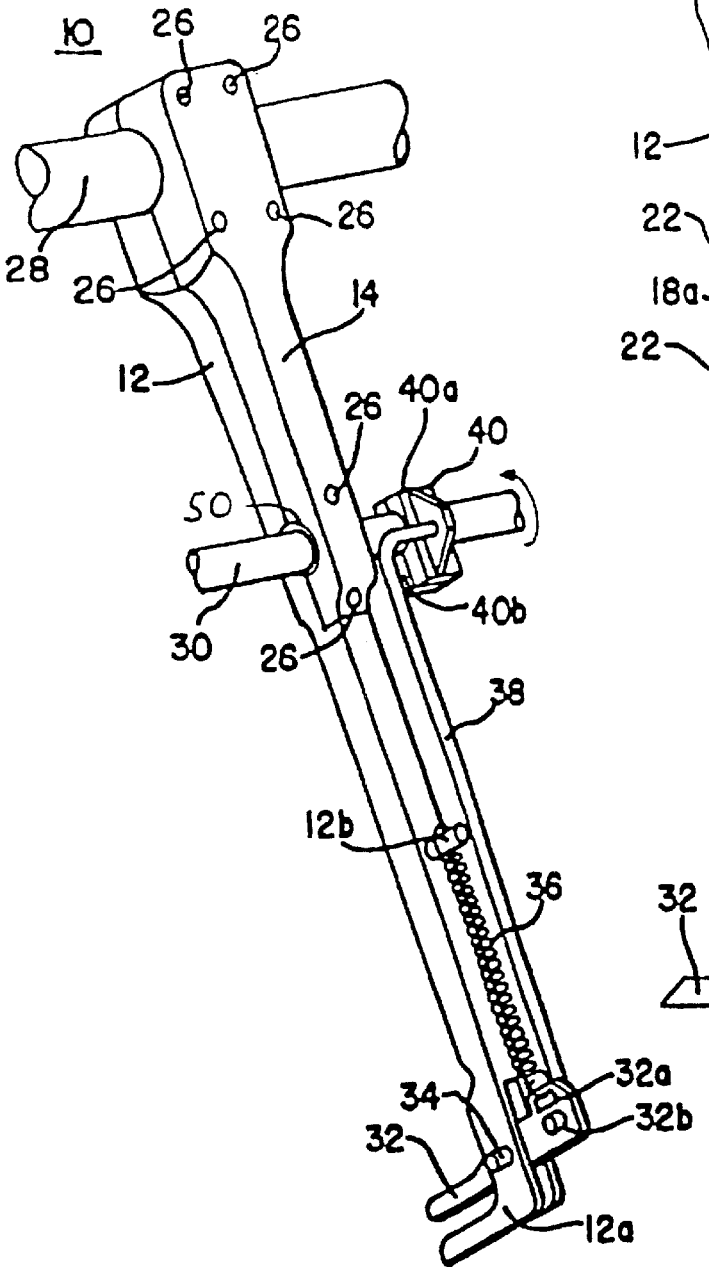
FIG. 1 is a perspective view of the gripper arm assembly mounted on a swing shaft and an operating lever shaft.

The principles of the invention are particularly useful when embodied in a gripper arm assembly as shown in FIG. 1, generally indicated by the numeral 10. In a preferred embodiment as better seen in FIG. 1, the gripper arm assembly 10 includes an elongated gripper arm main body 12 having a gripper portion 12*a* and an attachable arm clamp 14. Elements that work in conjunction with the arm main body 12 and clamp 14 to accomplish the task of grasping items, include a movable gripper jaw 32, a pivot pin 34 for the jaw 32, a return/tension spring 36, an operating rod 38 and an operating lever 40 for opening and closing the jaw 32.

Figure 2:
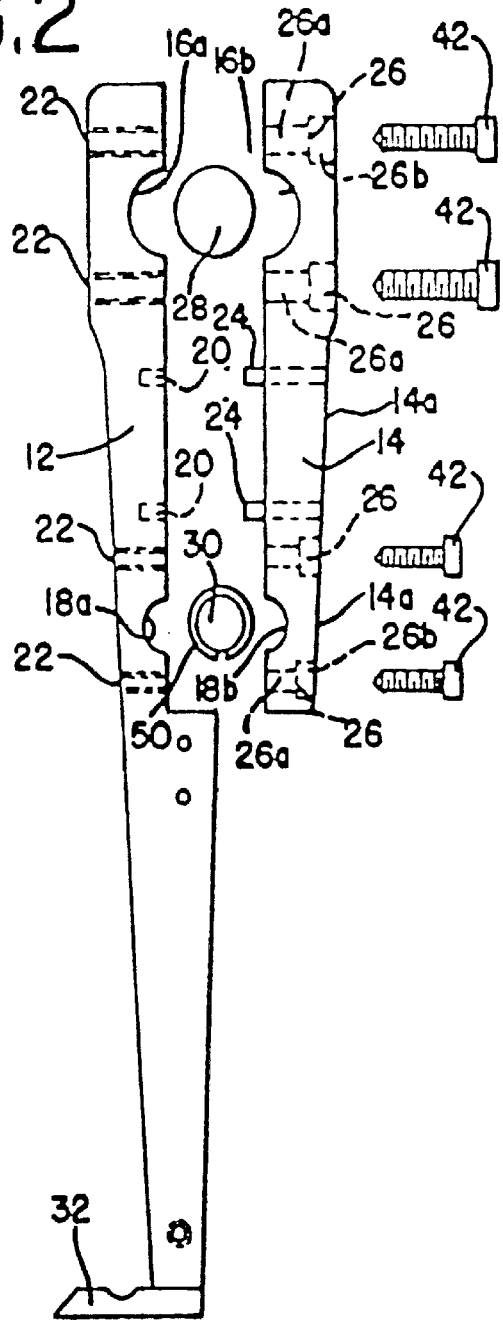
FIG. 2 is a side plan view of the arm main body portion separated from the arm clamp and also showing a cross-sectional view of the swing shaft and operating lever shaft.
Figure 2A:
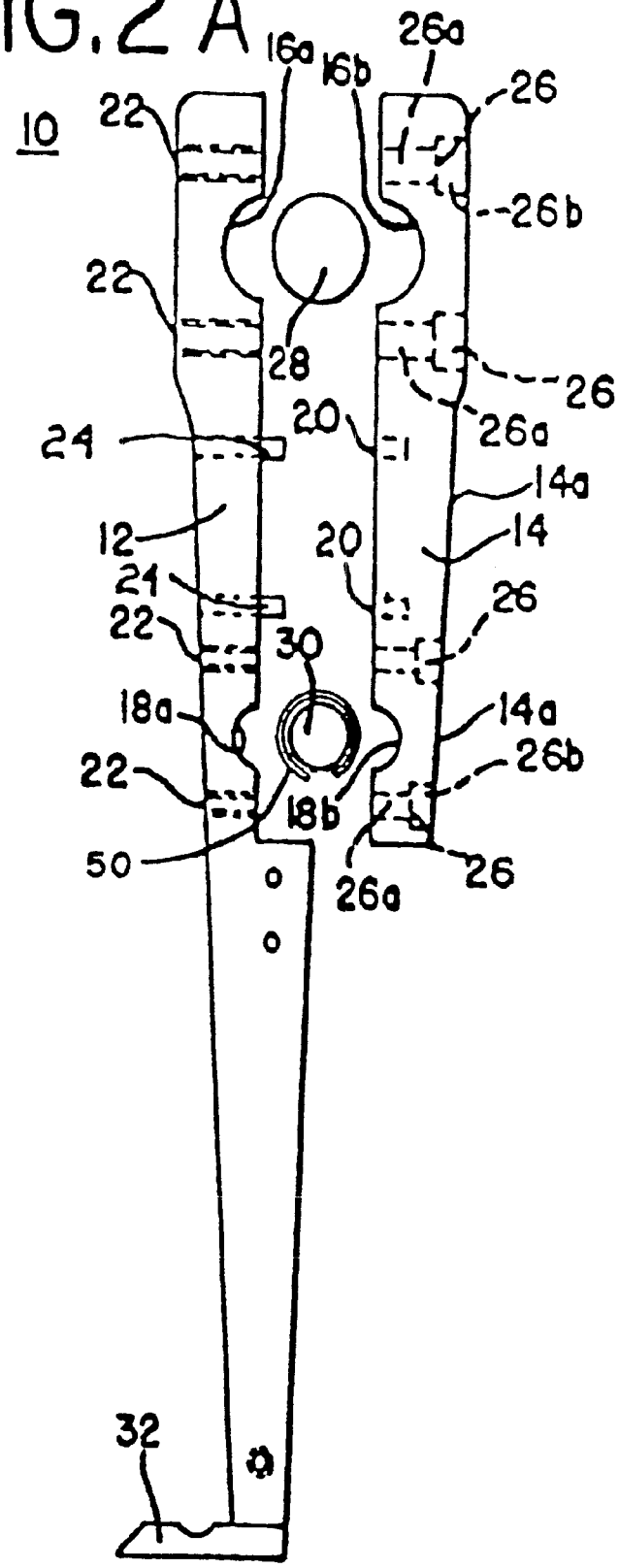
FIG. 2A is a side plan view of an alternative embodiment of the arm main body portion separated from the arm clamp and also showing a cross-sectional view of the swing shaft and operating lever shaft.
Figures 3, 4, 5, 6:
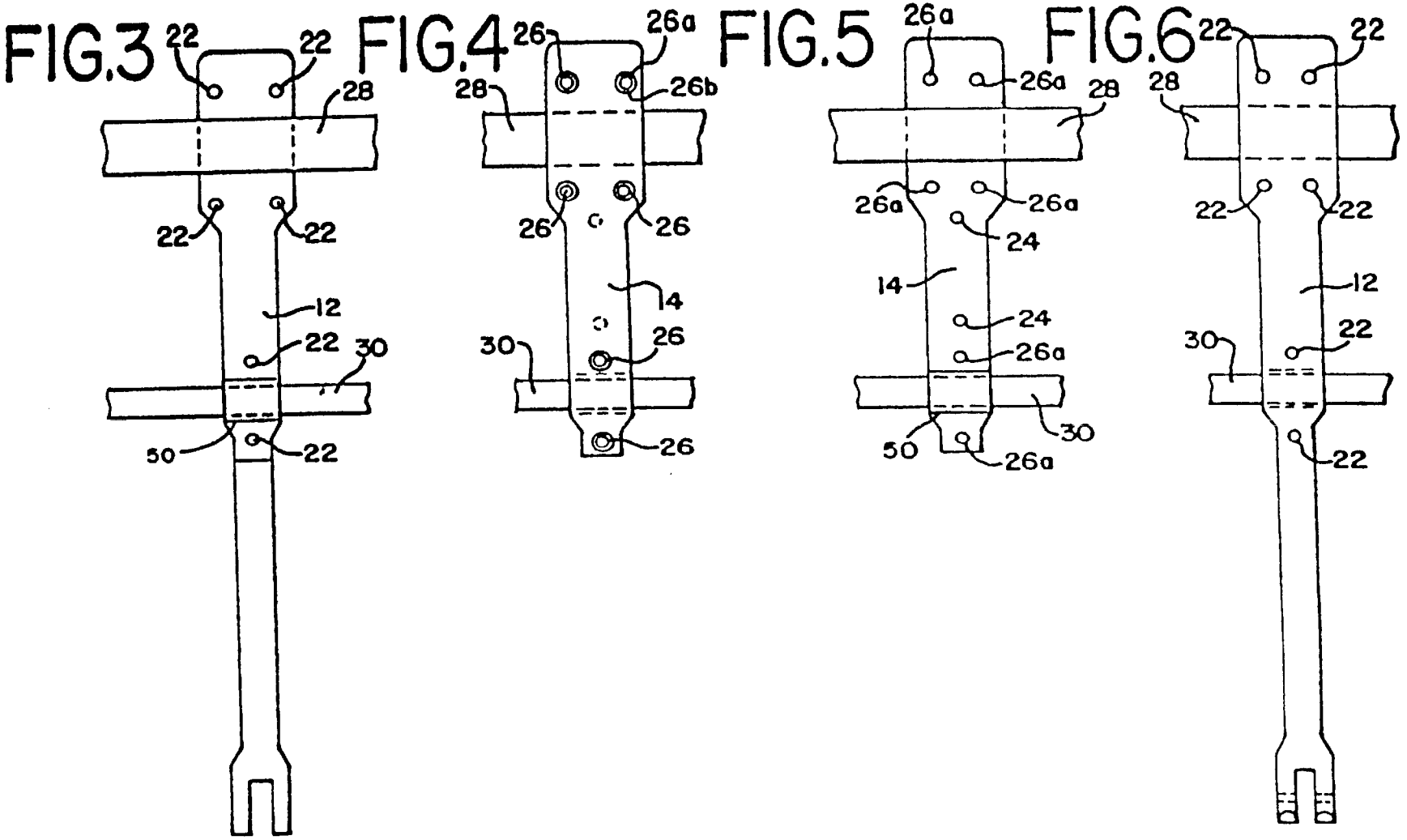
FIG. 3 is a rear plan view of the arm main body placed against a swing shaft and operating lever shaft.
FIG. 4 is a front plan view of the arm clamp placed against a swing shaft and operating lever shaft.
FIG. 5 is a rear plan view of the arm clamp placed against a swing shaft and an operating lever shaft.
FIG. 6 is a front plan view of the arm main body placed against a swing shaft and an operating lever shaft.
Figure 7:
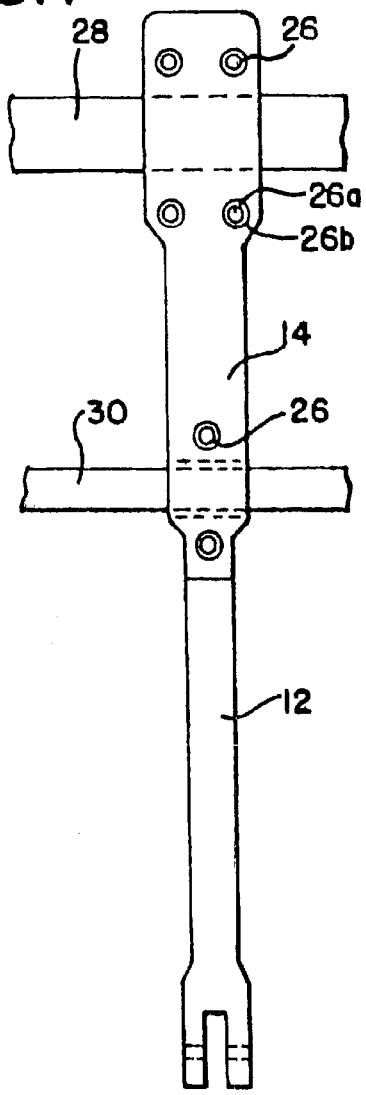
FIG. 7 is a rear plan view of the arm main body attached to the arm clamp portion with both portions mounted to the swing shaft and operating lever shaft.
Figure 8:
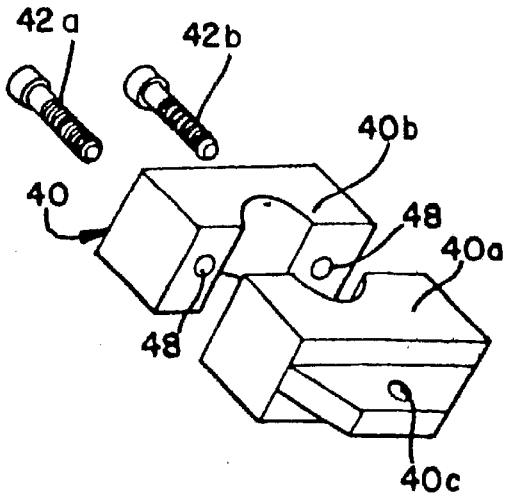
FIG. 8 is an exploded perspective view of the operating lever showing two connecting bolts.
Figure 9:
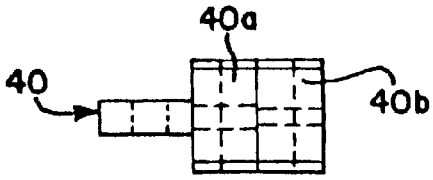
FIG. 9 is a top plan view of the operating lever.
Figure 10:
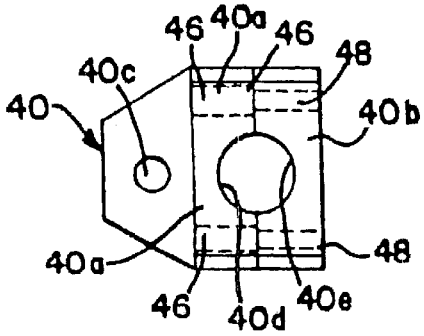
FIG. 10 is a side plan view of the operating lever.
Figure 11:
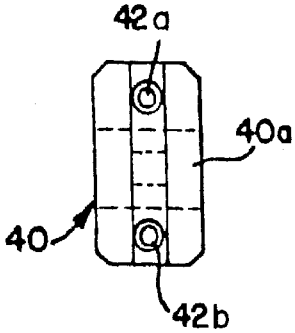
FIG. 11 is a front plan view of the operating lever.

As better seen in FIG. 2, the arm main body 12 has a swing shaft semi-circular cut-out section 16*a*, an operating lever shaft semi-circular cut-out section 18*a*, and a gripper portion 32. The arm main body 12 also has two alignment apertures 20 therein. There are also six threaded bolt holes 22 extending through the main body 12. The arm clamp 14 has a corresponding swing shaft semi-circular cut-out section 16b and an operating lever shaft semi-circular cut-out section 18*b* therein. Extending from the arm clamp 14 are two extending alignment pins 24. On opposite sides of the swing shaft cut-out section 16*b* are bolt holes 26. Each bolt hole 26 has a narrow portion 26*a* for accommodating the passing of an elongated portion of a bolt 42 therethrough and a widened portion 26*b* for accommodating placement of the head of a bolt 42 below the outside surface 14*a* of the arm clamp 14.

The gripper arm main body 12 and clamp 14 are attached to a swing shaft 28 and an operating lever shaft 30 by placing the arm main body 12 against both shafts 28, 30 so that the swing shaft cut-out section 16*a* fits over approximately half the diameter of the swing shaft 28 and by placing the operating lever shaft cut-out section 18*a* over approximately half the diameter of the operating lever shaft 30. Next, the arm clamp 14 is placed against both shafts 28, 30 opposite the arm main body 12 so that the upper shaft cut-out section 16*b* fits over approximately half the diameter of the swing shaft 28 and is opposite upper shaft cut-out section 16*a*. The operating lever shaft cut-out section 18*b* fits over approximately half the diameter of the operating lever shaft 30 and is opposite the operating lever shaft cut-out section 18*a*. A one-piece split nylon bushing 50 fits around shaft 30 and between the shaft 30 and cut-out sections 18*a* and 18*b*. Alignment pins 24 fit into apertures 20 as the arm main body 12 is mounted on shafts 28, 30 to align and join the arm main body 12 with the arm clamp 14. The pins 24 align the arm clamp 14 with the arm main body 12 when joined together on the shafts 28 and 30. Of course an inverse alignment pin/aperture alignment arrangement would suffice as well, whereas alignment pins 24 extend from the main body 12 and fit into corresponding apertures 20 of the arm clamp 14. Threaded bolts 42 are securely fastened into holes 26 and 22 to attach the arm clamp 14 to the arm main body 12 onto shafts 28 and 30.

As seen in FIG. 1, a two-piece operating lever 40 is mounted adjacent the arm main body 12 and arm clamp 14 on the operating shaft 30. As better seen in FIGS. 8–11, the operating lever 40 includes a pivot element 40*a* and a base element 40*b*. The pivot element has a pivot hole 40*c* and a semi-circular cut-out section 40*d* therein. Two bolt holes 46 extend into the pivot element 40*a*, one hole extending on each side of the semi-circular cut-out section 40*d*. The base element 40*b* has a corresponding semi-circular cut-out section 40*e* and two bolt holes 48 therein. Two bolts 42*a* and 42*b* are secured through holes 48 and into holes 46 to attach the pivot element 40*a* to the base element 40*b* and securely mount the operating lever 40 to the operating shaft 30.

As seen in FIG. 1, a gripper jaw is pivotally mounted to the gripper portion 12*a* of the arm main body 12. The gripper jaw 32 includes a pivot hole (not shown) a catch 32*a* and an operating rod hole 32*b*. A spring element 36 is attached at one end to a peg 12*b* extending from the arm main body 12 and attached at its other end to catch 32*a* causing the gripper jaw 32 to bias toward a closed position.

The operating arm 38 extends from the operating lever 40 to the gripper jaw 32. One end of the operating arm hooks into hole 40*c* of the operating lever while the other end of the operating rod 38 hooks into rod hole 32*b* of the gripper jaw 32.

As seen in FIG. 1, when the operating shaft 30 rotates in a counter clock-wise direction the operating rod 38 is pulled upwardly causing the attached gripper jaw 32 to pivot about pin 34 thereby closing the gripper jaw 32 onto gripper portion 12*a*. This is the gripping action utilized to grip items in the machine. Swing shaft 28 rotates to swing the entire gripper arm assembly and gripped item from one location to another location.

To remove the two-piece gripper arm body 12 and 14 from the shafts 28 and 30, simply remove the bolts 42 and unclip the operating rod 38 from the gripper jaw 32, as best seen in FIG. 2.

To remove the operating lever 40 from the operating lever shaft 30, simply remove bolts 42.

Figure 12:
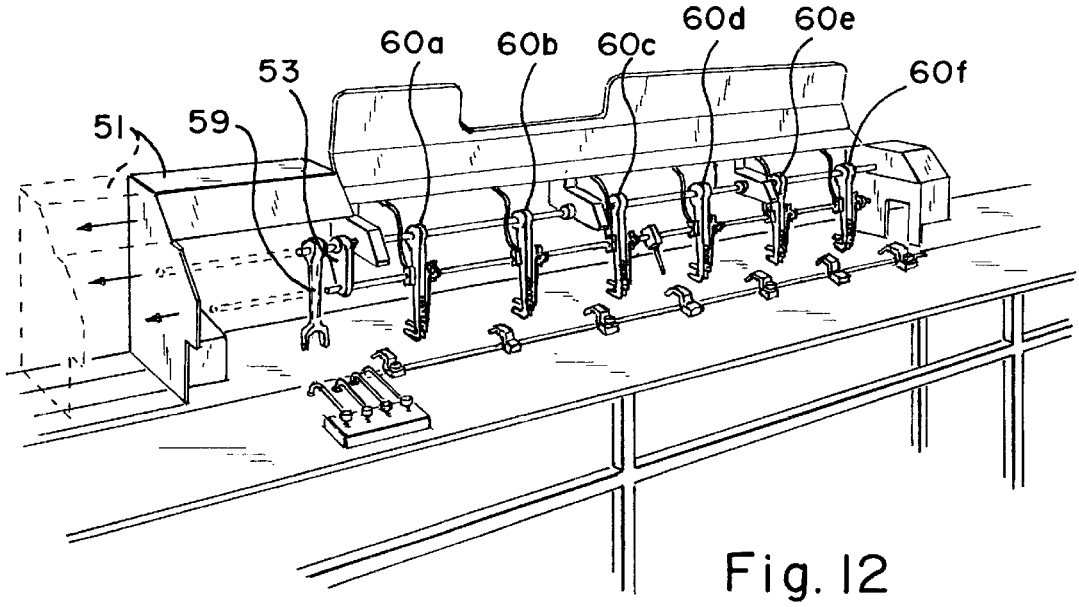
FIG. 12 is a perspective view of an inserter machine for inserting articles into envelopes and showing a drive mechanism for prior art gripper arms.
Figure 13:
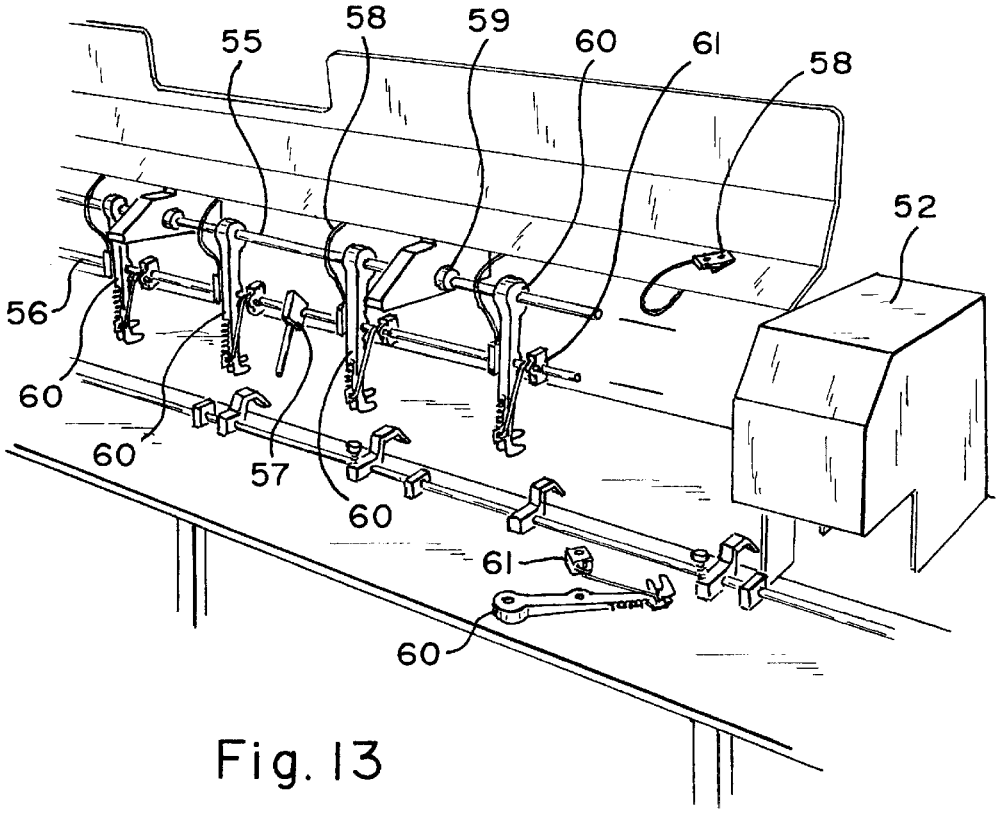
FIG. 13 is a perspective view, similar to that in FIG. 12, showing components required to be removed for repair, replacement, and/or modification of prior art gripper arm assemblies.

As seen in FIG. 12, the prior embodiment of gripper arm assemblies 60*a–f* required much more effort if the operator wanted to replace one gripper arm 60*a–f*. In the prior embodiment, the cover 51 or 52 needed to be removed and the shafts 55 and 56 pulled out, as is demonstrated in FIG. 13. For example, in order to replace the gripper jaw 62 on gripper arm 60*c* on the prior embodiment, the shafts 55 and 56 would be pulled through the gripper arms 60*f*, 60*e*, 60*d*, the manual jaw opener lever 57 and finally through gripper arm 60*c*, whereby the gripper arm 60*c* would be freely removeable to be repaired or replaced.

Once the gripper jaw 62 on gripper arm 60*c* was repaired or replaced, gripper arm 60*c*, the manual jaw opener lever 57, and gripper arms 60*d*, 60*e*, and 60*f*, would all have to be repositioned and shafts 55 and 56 inserted through the gripper arms 60*c–f*. This same process would need to be repeated for any gripper arm 60*a–f* that was removed in order the reach the one gripper arm that needed to be repaired or replaced. Furthermore, once the entire gripper arm assembly was reassembled all the gripper arms 60*a–f* would need to be recalibrated in order to synchronize the operation of the assembly. The present invention eliminates the need to remove the covers 51 and 52 and the shafts 55 and 56 in order to replace or perform a repair to the gripper arm 60.

What is claimed is:

1. A plurality of commonly operable and pivotable gripper arm assemblies all clamped on a fixed rotating swing shaft being rotatable about a stationary axis and all engaging a rotating operating shaft rotatably engaged by said gripper arm assemblies, the gripper assemblies each comprising:

an arm body having a first cut-out section to fixedly accommodate the rotating swing shaft, and a second cut-out section for rotatably accommodating the rotating operating shaft;

a gripper jaw mechanism operably mounted on said arm body and having an openable and closable jaw;

an arm clamp having a first cut-out section for fixedly clamping the rotating swing shaft, and a second cut-out section for rotatably accommodating the rotating operating shaft;

said arm clamp being removably attached to said arm body whereby each gripper arm assembly is independently demountable from said rotating swing shaft and rotating operating shaft;

said fixed swing shaft rotatable to pivotably swing said gripper arm assemblies therearound and simultaneously pivotably swing said rotating operating shaft in unison from one location to another location; and, said operating shaft being rotatable within said second cut-out sections of the arm body and arm clamp whereby to be mechanically linked to said gripper jaw mechanism to open and close said jaw of each said gripper jaw mechanism whereby the jaws are capable of gripping and ungripping items.

2. A gripper arm assembly of claim 1, wherein the arm body and arm clamp further include a bushing at the second cut-out sections for the rotating operating shaft.

3. A gripper arm assembly of claim 2 wherein the bushing is a split nylon bushing.

4. A machine having a plurality of commonly operable and pivotable gripper arm assemblies all fixedly mounted on a first rotatable shaft being rotatable about a stationary axis and all engaging a second rotatable shaft rotatable engaged by said gripper arm assemblies, the machine being useful for gripping items and moving the items from one location to another, the gripper arm assemblies each comprising:

an arm body having a gripper jaw end and an attachment end, the arm body having a first recessed surface at the attachment end and a second recessed surface between the attachment end and the gripper jaw end;

a gripper jaw mechanism operably mounted at the gripper jaw end of the arm body and having an openable and closable jaw;

an arm clamp having corresponding first and second recessed surfaces cooperating with the first and second recessed surfaces on the arm body to define a first channel for fixedly receiving the first rotatable shaft and a second channel for rotatably receiving the second rotatable shaft;

a bushing disposed within the second channel facilitating the rotation therein of said second rotatable shaft;

the arm clamp being removably attached to the arm body whereby each gripper arm assembly is independently demountable from said first and second rotatable shafts; and said arm body and arm clamp cooperating to directly engage the first and second rotatable shafts wherein the first rotating shaft is fixed in said first channel whereby the gripper arm assembly and second rotatable shaft pivot in unison about said stationary axis by means of the rotation of said first rotating shaft and wherein the second shaft is rotatable within said bushing; and, said second rotatable shaft being mechanically linked to said gripper mechanism whereby to operate said gripper jaw mechanism to open and close said jaw thereof for gripping and ungripping items.

5. A gripper arm assembly of claim 4, wherein the recessed surfaces are defined by semicircular arcs.

6. A gripper arm assembly of claim 4 wherein the bushing is a split sleeve bushing.

* * * * *